US010294945B2

(12) United States Patent
Xu et al.

(10) Patent No.: US 10,294,945 B2
(45) Date of Patent: May 21, 2019

(54) FAN AND IMPELLER THEREOF

(71) Applicants: COOLER MASTER CO., LTD., New Taipei (TW); Cooler Master (Hui Zhou) Co., Ltd., Huizhou, Guangdong Province (CN)

(72) Inventors: Shiman Xu, Chaozhou (CN); Jiasheng Lai, Boluo County (CN); Wen-Chun Hsu, New Taipei (TW)

(73) Assignees: COOLER MASTER (HUI ZHOU) CO., LTD., Guangdong Province (CN); COOLER MASTER CO., LTD., New Taipei (TW)

( * ) Notice: Subject to any disclaimer, the term of this patent is extended or adjusted under 35 U.S.C. 154(b) by 284 days.

(21) Appl. No.: 14/474,185

(22) Filed: Sep. 1, 2014

(65) Prior Publication Data

US 2015/0064011 A1 Mar. 5, 2015

(30) Foreign Application Priority Data

Sep. 3, 2013 (CN) ..... 2013 2 0545153 U

(51) Int. Cl.

| | |
|---|---|
| ***F04D 17/02*** | (2006.01) |
| ***F04D 19/00*** | (2006.01) |
| ***F04D 29/16*** | (2006.01) |
| ***F04D 29/28*** | (2006.01) |
| ***F04D 29/32*** | (2006.01) |
| ***F04D 29/68*** | (2006.01) |

(52) U.S. Cl.

CPC ..... *F04D 17/025* (2013.01); *F04D 19/002* (2013.01); *F04D 29/164* (2013.01); *F04D 29/282* (2013.01); *F04D 29/325* (2013.01); *F04D 29/326* (2013.01); *F04D 29/681* (2013.01)

(58) Field of Classification Search

CPC ..... F04D 17/025; F04D 19/00; F04D 19/002; F04D 19/007; F04D 19/022; F04D 29/32; F04D 29/325; F04D 29/326

See application file for complete search history.

(56) References Cited

U.S. PATENT DOCUMENTS

| | | | | | |
|---|---|---|---|---|---|
| 1,986,151 | A | * | 1/1935 | Johnston | F04D 29/327 416/193 R |
| 4,358,245 | A | * | 11/1982 | Gray | F01P 7/06 123/41.49 |
| 4,548,548 | A | * | 10/1985 | Gray, III | F01P 5/06 123/41.49 |
| 5,096,382 | A | * | 3/1992 | Gratzer | B63H 1/16 416/189 |
| 5,755,557 | A | * | 5/1998 | Alizadeh | F04D 29/326 416/169 A |

(Continued)

*Primary Examiner* — Christopher M Koehler

(74) *Attorney, Agent, or Firm* — McDermott Will & Emery LLP

(57) ABSTRACT

An impeller includes a fan frame, a hub, a plurality of axial blades and a plurality of wind guiding blades. The fan frame has a wind inlet, a wind outlet and an inner ring-shaped oblique surface, wherein the wind inlet is opposite to the wind outlet, and the inner ring-shaped oblique surface is formed at an inner side wall of the fan frame and adjacent to the wind inlet. The hub is disposed in the fan frame. The axial blades are connected to the inner side wall of the fan frame and the hub. The wind guiding blades protrude from the inner ring-shaped oblique surface.

14 Claims, 4 Drawing Sheets

(56) References Cited

U.S. PATENT DOCUMENTS 5,810,555 A * 9/1998 Savage ..... F04D 29/384 416/189
6,375,427 B1 * 4/2002 Williams ..... F04D 29/326 416/169 A
8,192,141 B1 * 6/2012 Dale ..... F02C 3/073 415/199.5
2003/0012653 A1 * 1/2003 Diemunsch ..... F04D 29/023 416/193 R
2006/0233646 A1 * 10/2006 Vidal ..... F04D 29/662 416/144
2007/0104581 A1 * 5/2007 Stagg ..... B29C 33/3835 416/189
2008/0159867 A1 * 7/2008 Yang ..... F04D 29/023 416/203
2009/0148294 A1 * 6/2009 Jarrah ..... F04D 29/666 416/189
2010/0068060 A1 * 3/2010 Ota ..... F04D 29/325 416/179
2010/0086405 A1 * 4/2010 Higo ..... F04D 29/325 416/189
2010/0183445 A1 * 7/2010 Jia ..... F04D 29/384 416/223 R
2010/0232971 A1 * 9/2010 Chen ..... F04D 29/384 416/223 R
2010/0260608 A1 * 10/2010 Suzuki ..... F04D 29/326 416/204 R
2011/0226000 A1 * 9/2011 Chiu ..... B05B 3/105 62/272
2013/0115087 A1 * 5/2013 Olmo ..... F04D 29/326 416/189
2013/0170995 A1 * 7/2013 Chen ..... F04D 19/002 416/193 R
2013/0189082 A1 * 7/2013 Kan ..... F04D 25/088 415/143
2013/0189129 A1 * 7/2013 Genereux ..... F04D 29/666 417/313
2013/0259667 A1 * 10/2013 Huang ..... F04D 19/002 415/185
2014/0056710 A1 * 2/2014 Henner ..... F04D 29/326 416/189
2014/0086730 A1 * 3/2014 Chang ..... F04D 25/166 415/143
2015/0354598 A1 * 12/2015 Dygert ..... F04D 29/164 415/208.2

* cited by examiner

FAN AND IMPELLER THEREOF

This application claims the benefit of China Application No. 201320545153.5, which was filed on Sep. 3, 2013, and is incorporated herein by reference.

BACKGROUND OF THE INVENTION

1. Field of the Invention

The invention relates to a fan and an impeller thereof and, more particularly, to an impeller capable of increasing wind flux at the wind inlet and outlet effectively and a fan equipped with the impeller.

2. Description of the Prior Art

Heat dissipating device is a significant component for electronic products. When an electronic product is operating, the current in circuit will generate unnecessary heat due to impedance. If the heat is accumulated in the electronic components of the electronic product without dissipating immediately, the electronic components may get damage due to the accumulated heat. Therefore, the performance of heat dissipating device is a significant issue for the electronic product. So far the heat dissipating device used in the electronic product usually consists of a heat pipe, a heat dissipating fin and a fan, wherein a heat absorbing segment of the heat pipe contacts the electronic component, which generates heat during operation, a heat dissipating segment of the heat pipe is connected to the heat dissipating fin, and the fan blows air to the heat dissipating fin, so as to dissipate heat. However, the axial wind flux at the wind inlet and outlet of a conventional fan is limited, and the size of the wind inlet is the same as the size of the wind outlet, such that the wind flux cannot be directed to the heat source effectively. Accordingly, the heat dissipating effect is limited.

SUMMARY OF THE INVENTION

The invention provides an impeller capable of increasing wind flux at the wind inlet and outlet effectively and a fan equipped with the impeller, so as to solve the aforesaid problems.

According to an embodiment of the invention, an impeller comprises a fan frame, a hub, a plurality of axial blades and a plurality of wind guiding blades. The fan frame has a wind inlet, a wind outlet and an inner ring-shaped oblique surface, wherein the wind inlet is opposite to the wind outlet, and the inner ring-shaped oblique surface is formed at an inner side wall of the fan frame and adjacent to the wind inlet. The hub is disposed in the fan frame. The axial blades are connected to the inner side wall of the fan frame and the hub. The wind guiding blades protrude from the inner ring-shaped oblique surface.

In this embodiment, an internal diameter of the fan frame along the inner ring-shaped oblique surface decreases gradually from the wind inlet to the wind outlet, such that the wind outlet is smaller than the wind inlet.

According to another embodiment of the invention, a fan comprises a stator and an impeller. The impeller is rotatably disposed on the stator. The impeller comprises a fan frame, a hub, a plurality of axial blades and a plurality of wind guiding blades. The fan frame has a wind inlet, a wind outlet and an inner ring-shaped oblique surface, wherein the wind inlet is opposite to the wind outlet, and the inner ring-shaped oblique surface is formed at an inner side wall of the fan frame and adjacent to the wind inlet. The hub is disposed in the fan frame. The axial blades are connected to the inner side wall of the fan frame and the hub. The wind guiding blades protrude from the inner ring-shaped oblique surface.

In this embodiment, an internal diameter of the fan frame along the inner ring-shaped oblique surface decreases gradually from the wind inlet to the wind outlet, such that the wind outlet is smaller than the wind inlet.

As mentioned in the above, the invention adds the wind guiding blades onto the inner ring-shaped oblique surface adjacent to the wind inlet, so as to increasing the axial wind flux at the wind inlet and outlet effectively. Furthermore, since the internal diameter of the fan frame along the inner ring-shaped oblique surface decreases gradually from the wind inlet to the wind outlet, the wind flux blown from the wind inlet will be pressurized according to Venturi tube principle, so as to enhance the heat dissipating effect at the hub. Moreover, since the wind outlet is smaller than the wind inlet of the fan frame, the wind flux blown from the wind inlet can be directed to the heat source effectively due to the smaller wind outlet, so as to enhance the heat dissipating effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
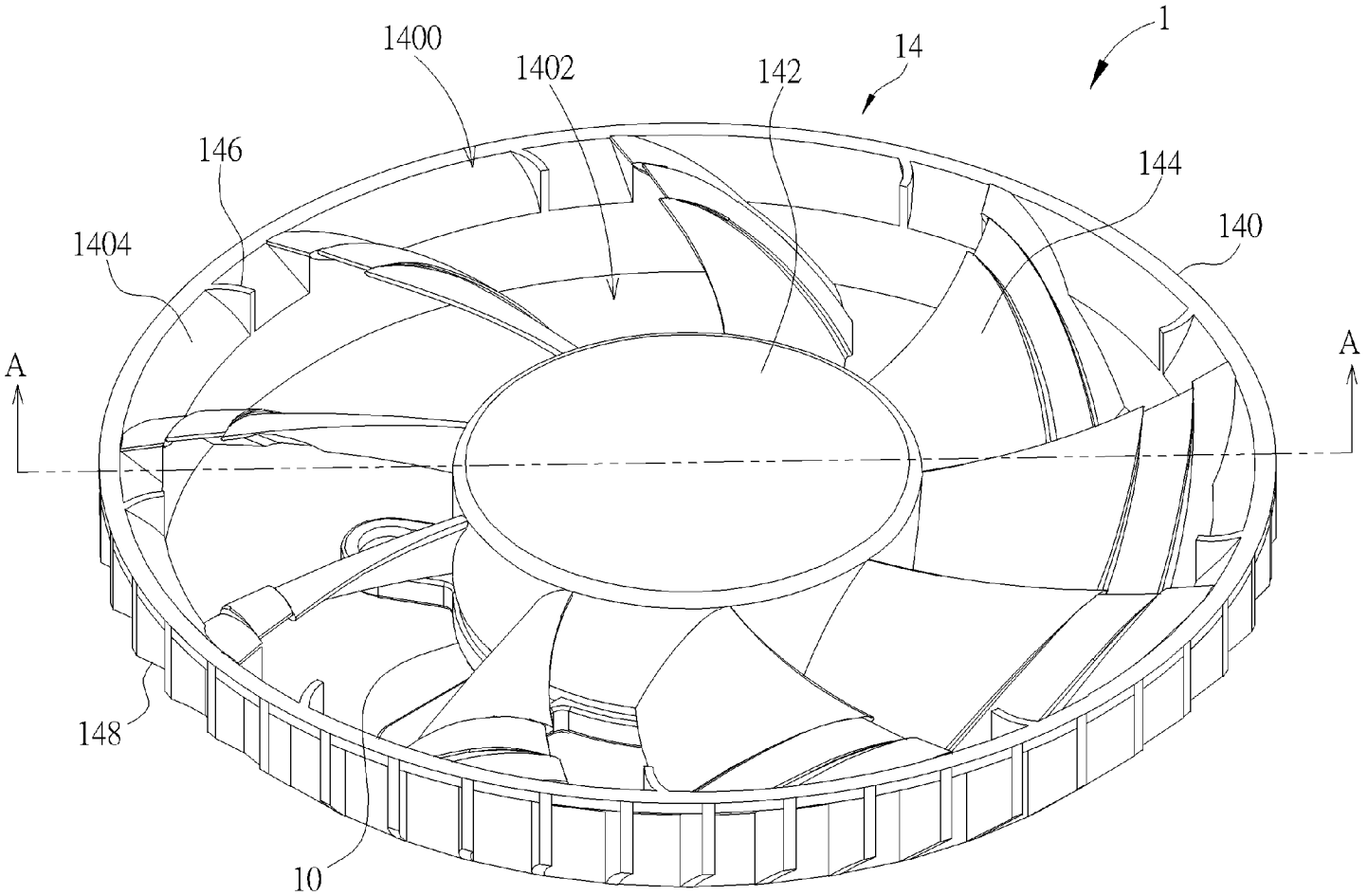
FIG. 1 is an assembly view illustrating a fan according to an embodiment of the invention.
Figure 2:
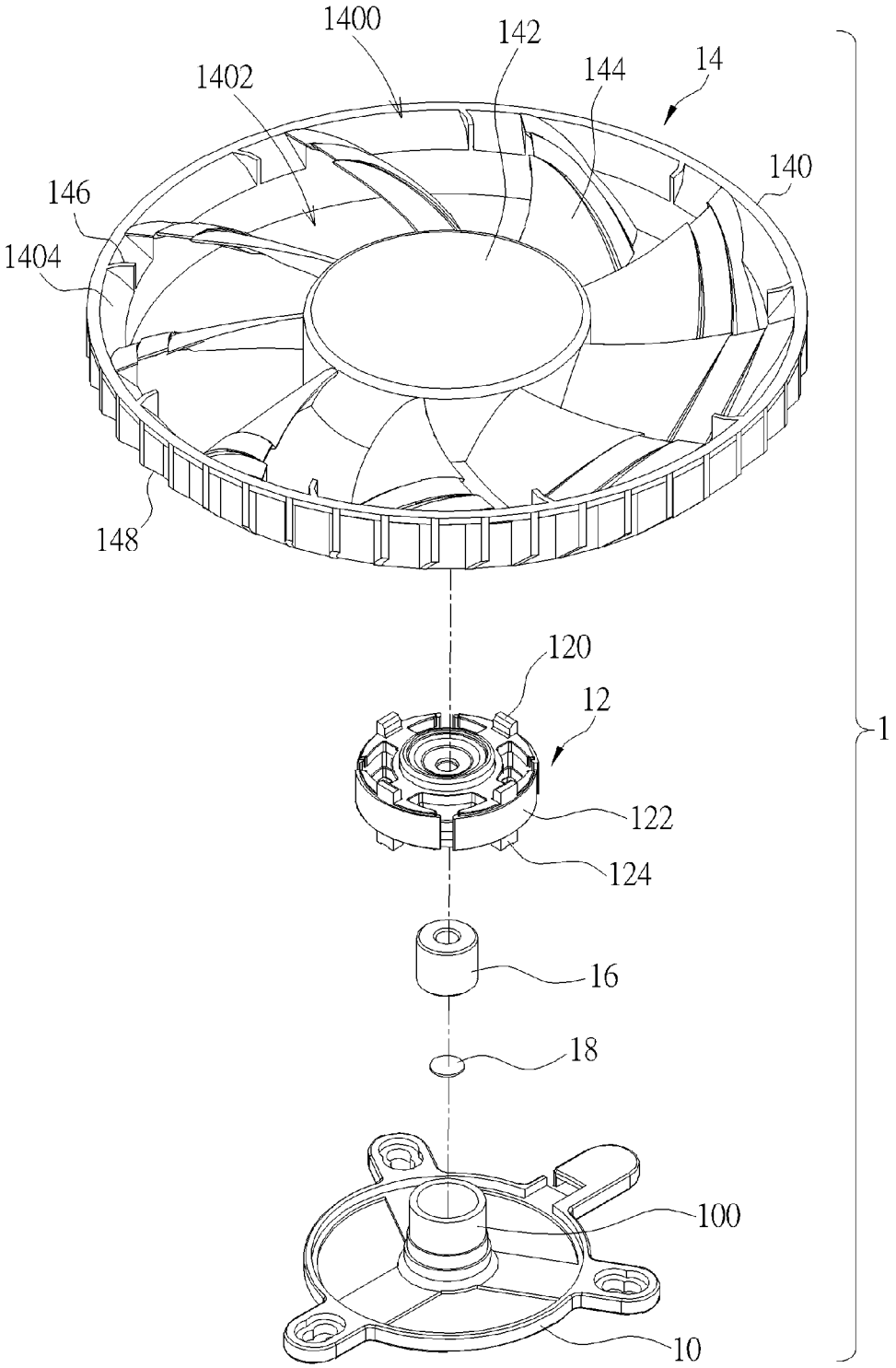
FIG. 2 is an exploded view illustrating the fan shown in FIG. 1.
Figure 3:
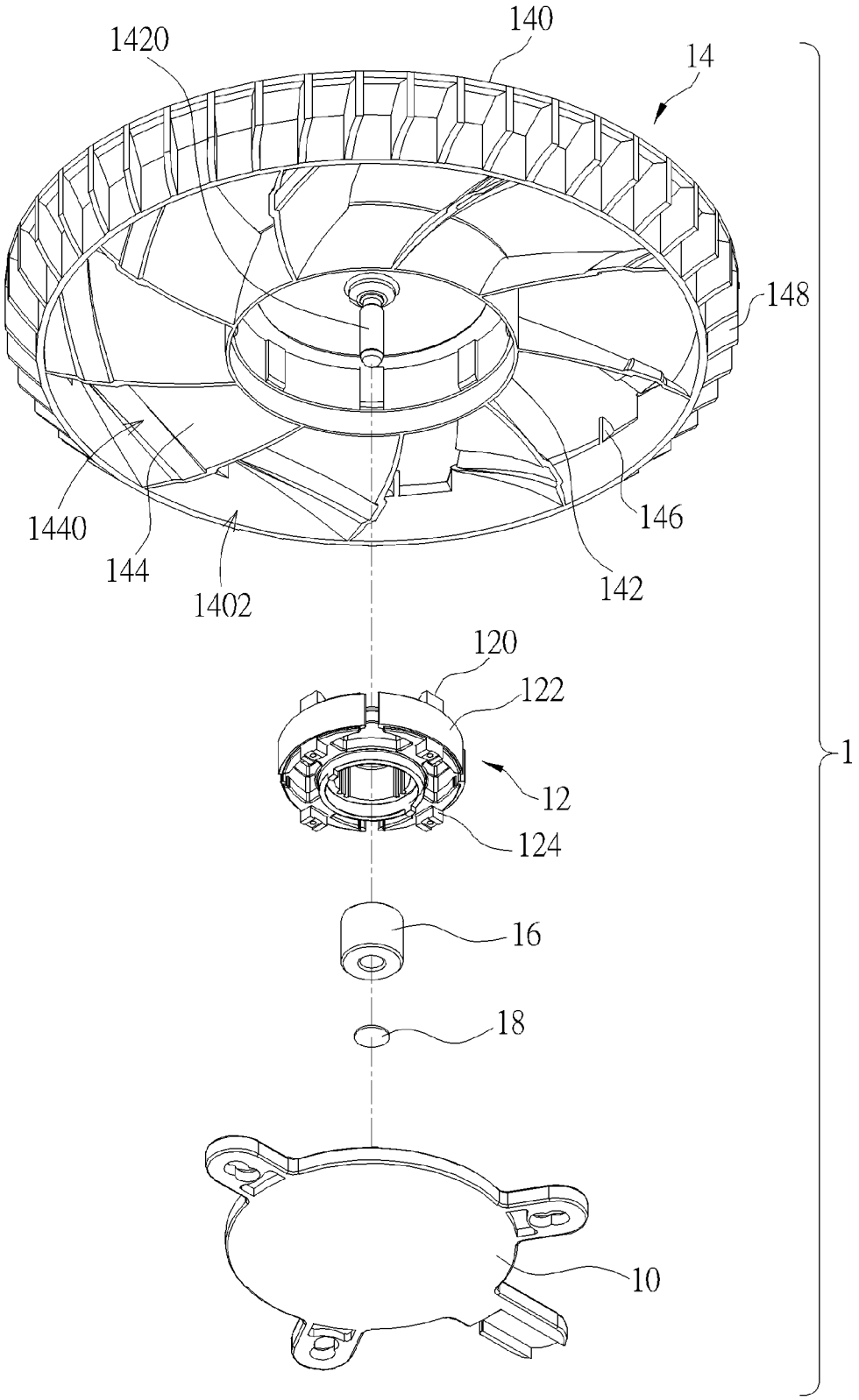
FIG. 3 is an exploded view illustrating the fan shown in FIG. 1 from another viewing angle.
Figure 4:
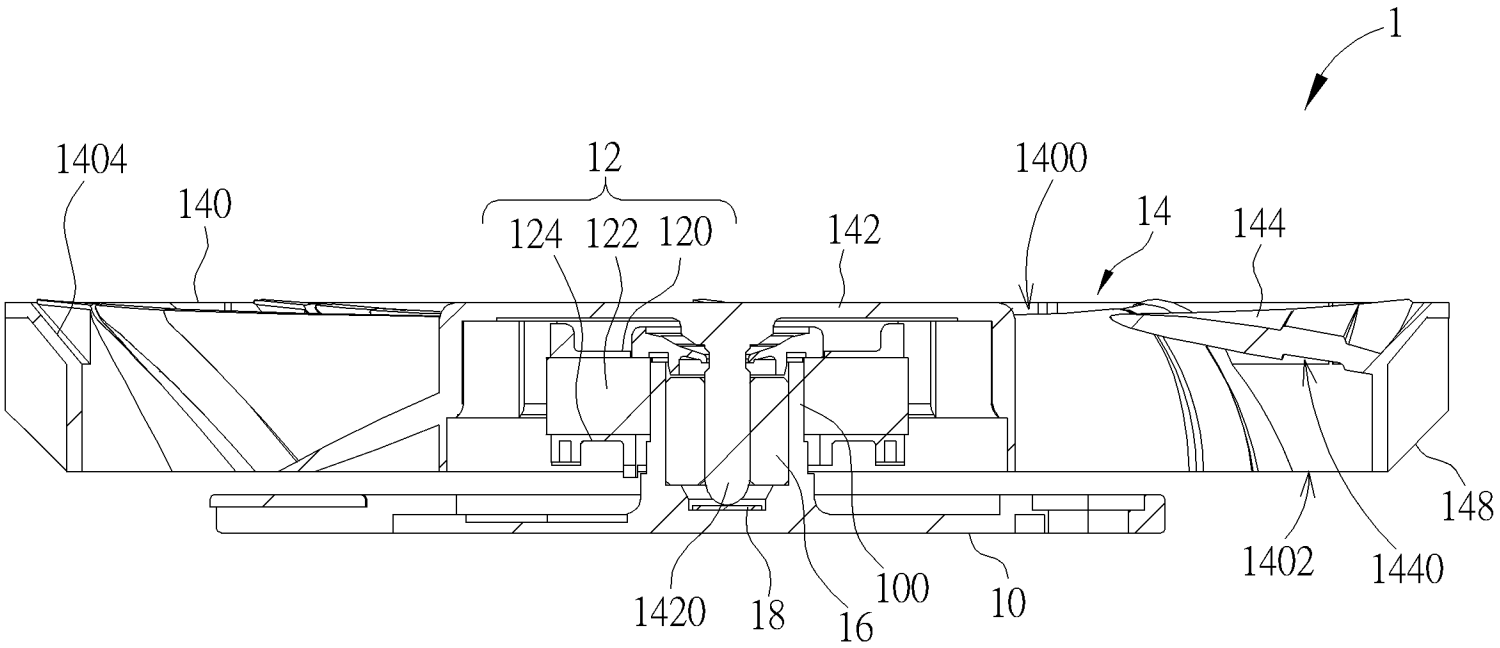
FIG. 4 is a cross-sectional view illustrating the fan along line A-A shown in FIG. 1.

Referring to FIGS. 1 to 4, FIG. 1 is an assembly view illustrating a fan 1 according to an embodiment of the invention, FIG. 2 is an exploded view illustrating the fan 1 shown in FIG. 1, FIG. 3 is an exploded view illustrating the fan 1 shown in FIG. 1 from another viewing angle, and FIG. 4 is a cross-sectional view illustrating the fan 1 along line A-A shown in FIG. 1. As shown in FIGS. 1 to 4, the fan 1 comprises a base 10, a stator 12, an impeller 14, a bearing 16 and a wearproof member 18. The base 10 has an axial tube 100. The bearing 16 and the wearproof member 18 are disposed in the axial tube 100. The stator 12 is sleeved on the axial tube 100. The stator 12 comprises an upper insulated frame 120, a silicon steel sheet assembly 122 and a lower insulated frame 124. The silicon steel sheet assembly 122 is sandwiched in between the upper insulated frame 120 and the lower insulated frame 124, wherein the silicon steel sheet assembly 122 essentially consists of a plurality of silicon steel sheets stacked with each other. In practical applications, a metal coil (not shown) is wound around the teeth of the upper insulated frame 120, the silicon steel sheet assembly 122 and the lower insulated frame 124.

The impeller 14 comprises a fan frame 140, a hub 142, a plurality of axial blades 144, a plurality of wind guiding blades 146 and a plurality of centrifugal blades 148. The fan frame 140 has a wind inlet 1400, a wind outlet 1402 and an inner ring-shaped oblique surface 1404, the wind inlet 1400 is opposite to the wind outlet 1402, the inner ring-shaped oblique surface 1404 is formed at an inner side wall of the fan frame 140 and adjacent to the wind inlet 1400. The hub 142 is disposed in the fan frame 140. The hub 142 has a pivot 1420. The pivot 1420 is inserted into the bearing 16 and abuts against the wearproof member 18, such that the impeller 14 is rotatably disposed on the stator 12. The axial blades 144 are connected to the inner side wall of the fan frame 140 and the hub 142. The wind guiding blades 146 protrude from the inner ring-shaped oblique surface 1404. In other words, the wind guiding blades 146 are adjacent to the wind inlet 1400 of the fan frame 140. As shown in FIG. 4, an internal diameter of the fan frame 140 at the wind inlet 1400 along the inner ring-shaped oblique surface 1404 decreases gradually from the wind inlet 1400 to the wind outlet 1402, such that the wind outlet 1402 is smaller than the wind inlet 1400. In this embodiment, the axial blades 144 and the wind guiding blades 146 are arranged, but not limited to, interlacedly. In another embodiment, more than one wind guiding blade 146 may be disposed between two axial blades 144 according to practical applications. The centrifugal blades 148 are connected to an outer side wall of the fan frame 140.

When the hub 142 rotates with respect to the stator 12, the hub 142 will drive the axial blades 144, the fan frame 140, the wind guiding blades 146 and the centrifugal blades 148 to rotate simultaneously. At this time, the rotating axial blades 144 will blow air into the fan frame 140 from the wind inlet 1400. At the same time, the wind guiding blades 146 adjacent to the wind inlet 1400 can increase the axial wind flux at the wind inlet effectively. Since the wind flux at the wind inlet increases, the wind flux blown out of the wind outlet 1402 of the fan frame 140 will increase accordingly, so as to enhance the heat dissipating effect effectively. Furthermore, since the internal diameter of the fan frame 140 at the wind inlet 1400 along the inner ring-shaped oblique surface 1404 decreases gradually from the wind inlet 1400 to the wind outlet 1402, the wind flux blown from the wind inlet 1400 will be pressurized according to Venturi tube principle, so as to enhance the heat dissipating effect at the hub 142. Moreover, since the wind outlet 1402 is smaller than the wind inlet 1400, the wind flux blown from the wind inlet 1400 can be directed to the heat source (not shown) effectively due to the smaller wind outlet 1402, so as to enhance the heat dissipating effect. Still further, the rotating centrifugal blades 148 will blow the air to the surroundings, so as to enhance the heat dissipating effect around the fan 1. In other words, the fan 1 of the invention has the functions of centrifugal fan and axial fan.

In this embodiment, each of the axial blades 144 has a recess portion 1440 and the recess portion 1440 faces the wind outlet 1402. Accordingly, when the impeller 14 is rotating, the recess portion 1440 of the axial blade 144 can reduce noise effectively.

As mentioned in the above, the invention adds the wind guiding blades onto the inner ring-shaped oblique surface adjacent to the wind inlet, so as to increasing the axial wind flux at the wind inlet and outlet effectively. Furthermore, since the internal diameter of the fan frame along the inner ring-shaped oblique surface decreases gradually from the wind inlet to the wind outlet, the wind flux blown from the wind inlet will be pressurized according to Venturi tube principle, so as to enhance the heat dissipating effect at the hub. Moreover, since the wind outlet is smaller than the wind inlet of the fan frame, the wind flux blown from the wind inlet can be directed to the heat source effectively due to the smaller wind outlet, so as to enhance the heat dissipating effect. Still further, the invention may form the recess portion on one side of the axial blade facing the wind outlet, so as to reduce noise while the impeller is rotating.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An impeller comprising:

a fan frame having a wind inlet, a wind outlet and an inner ring-shaped oblique surface, the wind inlet being opposite to the wind outlet, the inner ring-shaped oblique surface being formed at an inner side wall of the fan frame and adjacent to the wind inlet;

a hub disposed in the fan frame;

a plurality of axial blades connected to the inner side wall of the fan frame and the hub, wherein each axial blade of the plurality of axial blades has a stepped recess portion that extends towards the wind inlet from a surface of the axial blades that faces the wind outlet, and wherein the stepped recess portion is defined by a first vertical sidewall and a second vertical sidewall, each extending between the wind inlet and the wind outlet, and a bottom portion extending radially between the first and second vertical sidewalls and transverse to the first and second vertical sidewalls;

a plurality of centrifugal blades axially disposed on an outer side wall of the fan frame; and a plurality of wind guiding blades protruding from the inner ring-shaped oblique surface, each wind guiding blade having a first end and a second end radially opposite the first end, the first end contacting the inner ring-shaped oblique surface and the second end being free of any connections.

2. The impeller of claim 1, wherein an internal diameter of the fan frame along the inner ring-shaped oblique surface decreases gradually from the wind inlet to the wind outlet, such that the wind outlet is smaller than the wind inlet.

3. The impeller of claim 1, wherein the axial blades and the wind guiding blades are arranged interlacedly.

4. The impeller of claim 1, wherein each axial blade in its entirety is disposed between the inner side wall and the hub in a radial direction of the axial blade.

5. The impeller of claim 1, wherein each axial blade of the plurality of axial blades has only one stepped recess portion proximate the inner ring-shaped oblique surface.

6. A fan comprising:

a stator; and an impeller rotatably disposed on the stator, the impeller comprising:

a fan frame having a wind inlet, a wind outlet and an inner ring-shaped oblique surface, the wind inlet being opposite to the wind outlet, the inner ring-shaped oblique surface being formed at an inner side wall of the fan frame and adjacent to the wind inlet;

a hub disposed in the fan frame;

a plurality of axial blades connected to the inner side wall of the fan frame and the hub, wherein each axial blade of the plurality of axial blades has a stepped recess portion that extends towards the wind inlet from a surface of the axial blades that faces the wind outlet, and wherein the stepped recess portion is defined by a first vertical sidewall and a second vertical sidewall, each extending between the wind inlet and the wind outlet, and a bottom portion extending radially between the first and second vertical sidewalls and transverse to the first and second vertical sidewalls;

a plurality of centrifugal blades axially disposed on an outer side wall of the fan frame; and a plurality of wind guiding blades protruding from the inner ring-shaped oblique surface, each wind guiding blade having a first end and a second end radially opposite the first end, the first end contacting the inner ring-shaped oblique surface and the second end being free of any connections.

7. The fan of claim 6, wherein an internal diameter of the fan frame along the inner ring-shaped oblique surface decreases gradually from the wind inlet to the wind outlet, such that the wind outlet is smaller than the wind inlet.

8. The fan of claim 6, wherein the axial blades and the wind guiding blades are arranged interlacedly.

9. An impeller comprising:

a fan frame having a wind inlet, a wind outlet and an inner ring-shaped oblique surface, the wind inlet being opposite to the wind outlet, the inner ring-shaped oblique surface being formed at an inner side wall of the fan frame and adjacent to the wind inlet;

a hub disposed in the fan frame;

a plurality of axial blades connected to the inner side wall of the fan frame and the hub, wherein each axial blade of the plurality of axial blades has a stepped recess portion that extends towards the wind inlet from a surface of the axial blades that faces the wind outlet, and wherein the stepped recess portion is defined by a first vertical sidewall and a second vertical sidewall, each extending between the wind inlet and the wind outlet, and a bottom portion extending radially between the first and second vertical sidewalls and transverse to the first and second vertical sidewalls;

a plurality of centrifugal blades disposed on an outer lower surface of the inner ring-shaped oblique surface and extending in a direction of the wind outlet; and a plurality of wind guiding blades protruding from the inner ring-shaped oblique surface, each wind guiding blade having a first end and a second end radially opposite the first end, the first end contacting the inner ring-shaped oblique surface and the second end being free of any connections.

10. The impeller of claim 9, wherein an internal diameter of the fan frame along the inner ring-shaped oblique surface decreases gradually from the wind inlet to the wind outlet, such that the wind outlet is smaller than the wind inlet.

11. The impeller of claim 9, wherein the axial blades and the wind guiding blades are arranged interlacedly.

12. A fan comprising:

a stator; and an impeller rotatably disposed on the stator, the impeller comprising:

a fan frame having a wind inlet, a wind outlet and an inner ring-shaped oblique surface, the wind inlet being opposite to the wind outlet, the inner ring-shaped oblique surface being formed at an inner side wall of the fan frame and adjacent to the wind inlet;

a hub disposed in the fan frame;

a plurality of axial blades connected to the inner side wall of the fan frame and the hub, wherein each axial blade of the plurality of axial blades has a stepped recess portion that extends towards the wind inlet from a surface of the axial blades that faces the wind outlet, and wherein the stepped recess portion is defined by a first vertical sidewall and a second vertical sidewall, each extending between the wind inlet and the wind outlet, and a bottom portion extending radially between the first and second vertical sidewalls and transverse to the first and second vertical sidewalls;

a plurality of centrifugal blades disposed on an outer lower surface of the inner ring-shaped oblique surface and extending in a direction of the wind outlet; and a plurality of wind guiding blades protruding from the inner ring-shaped oblique surface, each wind guiding blade having a first end and a second end radially opposite the first end, the first end contacting the inner ring-shaped oblique surface and the second end being free of any connections.

13. The fan of claim 12, wherein an internal diameter of the fan frame along the inner ring-shaped oblique surface decreases gradually from the wind inlet to the wind outlet, such that the wind outlet is smaller than the wind inlet.

14. The fan of claim 12, wherein the axial blades and the wind guiding blades are arranged interlacedly.

* * * * *